US011492086B2

(12) United States Patent
Chiara

(10) Patent No.: US 11,492,086 B2
(45) Date of Patent: Nov. 8, 2022

(54) INTEGRATED KITEBOARDING CANOPY SELF LAUNCHING AND LANDING SAFETY SYSTEMS

(71) Applicant: Peter Chiara, Deerfield Beach, FL (US)

(72) Inventor: Peter Chiara, Deerfield Beach, FL (US)

( * ) Notice: Subject to any disclaimer, the term of this patent is extended or adjusted under 35 U.S.C. 154(b) by 0 days.

(21) Appl. No.: 17/098,293

(22) Filed: Nov. 13, 2020

(65) Prior Publication Data

US 2021/0139120 A1 May 13, 2021

Related U.S. Application Data

(60) Provisional application No. 62/934,974, filed on Nov. 13, 2019.

(51) Int. Cl.
*B63H 9/072* (2020.01)
*B63H 9/08* (2006.01)

(52) U.S. Cl.
CPC ..... *B63H 9/072* (2020.02); *B63H 9/08* (2013.01)

(58) Field of Classification Search
CPC .. B63H 8/16; B63H 9/072; B63H 9/08; B64C 31/06
See application file for complete search history.

(56) References Cited

U.S. PATENT DOCUMENTS

| | | | | |
|---|---|---|---|---|
| 1,993,414 | A * | 3/1935 | Respess | B64C 39/022 244/33 |
| 2,279,152 | A * | 4/1942 | Whitehurst | B07C 3/085 186/16 |
| 2,850,819 | A * | 9/1958 | Payne | G09F 3/00 40/300 |
| 4,168,815 | A * | 9/1979 | Hodde | A63H 27/08 244/155 R |
| 7,866,271 | B2 * | 1/2011 | Wrage | B63H 9/069 114/102.16 |
| 8,117,977 | B2 * | 2/2012 | Reusch | B63H 9/072 114/102.16 |
| 9,914,521 | B1 * | 3/2018 | Hall-Snyder | B64B 1/66 |
| 10,569,871 | B2 * | 2/2020 | Chafe | B64C 31/06 |
| 2003/0025039 | A1 * | 2/2003 | Fischer | A63H 27/002 244/155 R |
| 2015/0048621 | A1 * | 2/2015 | Smeenk | F03D 5/00 290/55 |
| 2017/0267376 | A1 * | 9/2017 | Benedetto | B64B 1/005 |

* cited by examiner

*Primary Examiner* — Andrew Polay

(57) ABSTRACT

An integrated Kiteboarding canopy self-launching and landing safety system is presented. The system includes a base. The system also includes an attachment mechanism configured to attach to the base, wherein the attachment mechanism is structured to capture a kiteboarding canopy. The system additionally includes a release mechanism positionable on the base, wherein the release mechanism is arranged to be able to release a kiteboarding canopy upon actuation. Further, the system includes a securing mechanism configured to connect with the base, wherein the securing mechanism is configured to secure a kiteboarding canopy upon landing. And, the system also includes a manual and automatic device to control both landing and launching evolutions.

1 Claim, 7 Drawing Sheets

INTEGRATED KITEBOARDING CANOPY SELF LAUNCHING AND LANDING SAFETY SYSTEMS

FIELD OF THE INVENTION

The present invention relates to kiteboarding canopy systems, and particularly to integrated kiteboarding canopy self-launching and self-landing systems allowing independent personnel operating a kite canopy to safely secure and safely deploy a canopy when an operator is ready to engage and/or disengage with the kite canopy.

BACKGROUND OF THE INVENTION

Previous attempts to provide safe systems and methods for personnel handling kite canopies have required more than one person, have been cumbersome to set up and deploy and have been unsuccessfully implemented in many cases. in many instances, personnel operating kite canopies desire systems that are easily portable, convenient to deploy, and safe for a one-person operation, and thus far systems used to meet these goals have not been reliably achievable. Further, current methods and systems for self-launching and self-landing, due to their complexity, make these current methods cumbersome and unsafe.

The nature of handling canopies in high winds and in areas where strong wind gusts exist, render a sole sail operator susceptible to injury. Previous methods to keep kite canopy operators safe have not been reliable. There continues to be large numbers of injuries and fatalities due to the inability of a single canopy operator to manage to self-launch and land their kite safely.

Specifically, self-landing evolutions render a sole kiteboarding operator vulnerable to wind gusts and changes in wind directions during landing, and without a securing mechanism, could be dangerous to the operator. This makes current self-landing evolutions dangerous to solo operators.

Accordingly, there is an established need for canopy launching and landing safety systems which solve the aforementioned problems. Further, there is an established need for integrated kiteboarding canopy self-launching and self-landing safety systems, having various forms, that help canopy operators to safely secure, deploy, land, and manage a canopy with a single person and with minimal logistical steps to setup a system and that provides enhanced safety to a canopy operator.

SUMMARY OF THE INVENTION

An embodiment of the present invention can include a shore anchor device coupled to a canopy securing mechanism. The anchor device and the securing mechanism are rigidly connected and configured to minimize movement of the mechanism at all times during operation including when a canopy is secured in the securing mechanism. When winds and wind gusts affect the canopy, the canopy forces will be transmitted to the securing mechanism and anchors. The system can be designed to hold stationary the anchor and securing mechanism during periods of high winds and gust (up to and including winds and/or gusts of 35 mph). The securing mechanism can include clamps and/or arms. The size, shape, diameter, and other measurements and dimensions of the anchor, securing mechanism, clamps, and/or arms may be varied.

In another embodiment, the system can also include at least one release mechanism, the at least one release mechanism structured to release a canopy from a clamp upon physical actuation with, but not limited to a lanyard, lever, and/or a wireless device.

In yet another embodiment, the system can include a wireless control mechanism. The wireless control mechanism designed to release the canopy from the canopy clamp upon receiving a wireless control signal. Further the system can include a wireless control mechanism, the mechanism configured to secure the canopy when landing upon receiving a wireless control signal, to secure the canopy.

In an aspect, the system can include electronic solenoids. The electronic solenoids structured to hold secure the canopy in the canopy securing mechanism with electromagnetic force.

In another aspect, the system can also include WIFI and/or Bluetooth networks. The networks arranged to provide a communication means from a canopy operator to the canopy securing mechanism.

In yet another aspect the system can include canopy securing clamps, the clamps including 2 inches, 12 inches, 18 inches, 36 inches, and/or any length in between, In an embodiment, the system can include shore anchors, the anchors can include serrated edges for enhanced anchoring of the system.

In another embodiment, the system can also include anchors with stakes, the stakes arranged to be placed into below grade media, such as but not limited to sand, rock, mud, snow, and/or marsh areas.

In yet another embodiment, the system can include anchors with round tops, the tops configured for ease of insertion.

In an aspect, the system can include canopy securing clamps, the clamps including diameters 2", 12", 18", 24", 36" and/or any diameter in between. Further, the system can include lengths of 2", 6", 12", 36" and/or any length in between. Additionally, the system can include widths of 2", 6", 12", 36" and/or any width in between. Also, the system can include heights of 2", 6", 12", 36" and/or any height in between.

In another aspect, the system can also include anchoring mechanisms, the mechanisms including but not limited to augers, electrical motors, hydraulic actuators, and/or pneumatic devices.

In yet another aspect, the system can include locking mechanisms, the mechanisms including collapsible legs configured to allow for stakes and compactness.

In an embodiment, the system can include securing mechanisms with at least one inflatable tube, the at least one inflatable tube designed to spread wide with extra material to allow for larger canopies.

In another embodiment, the system can also include securing mechanisms with a u-shaped design, the shape incorporating a spring and arm under tension providing to secure canopies of various sizes to be effectively held.

In yet another embodiment, the system can include securing mechanisms with two pivoting arms structured such that when pressure is applied, the pivoting arms rotate cradling the kite's leading edge In an aspect, the system can include securing mechanisms with at least one pivoting arm, the at least one pivoting arm designed to rotate when pressure is applied and creates a cradle, the cradle holding the canopy in place with a temporary locking mechanism.

In another aspect, the system can also include securing mechanisms with a spring clamp mechanism, the spring clamp mechanism configured to clamp over tubes of a kite and can incorporate a release mechanism.

In yet another aspect, the system can include securing mechanisms for allowing a sole kiteboarding operator to secure a canopy prior to launching and configured to release the securing mechanisms when the operator is ready to operate the canopy. The releasing mechanisms can be mechanical, such as but not limited to a lanyard, a spool/reel assembly, a lever, rope, magnetic solenoid, pneumatic, hydraulic, and/or electro-mechanical device. The releasing mechanisms can be activated locally and/or remotely. Remote methods include wireless communications platforms allowing the operator to activate the releasing mechanism with a handheld device, wrist band, and/or activation button worn by the operator.

In an embodiment, the system can include securing mechanisms for allowing a sole kiteboarding operator to secure a canopy when landing a canopy and configured to engage the securing mechanisms when the operator is ready to secure the canopy. The securing mechanisms can be mechanical, such as but not limited to a lanyard, a spool/reel assembly, a lever, rope, magnetic solenoid, pneumatic, hydraulic, and/or electro-mechanical device. The securing mechanisms can be activated locally and/or remotely. Remote methods include wireless communications platforms allowing the operator to activate the securing mechanism with a handheld device, wrist band, and/or activation button worn by the operator.

In another embodiment, the system can also be configured to function over media such as but not limited to soil, snow, clay, rock, marsh, sand, and/or aggregate material.

In yet another embodiment, the system can include anchors with an external circumferential area configured to be impact with a special tool that imparts force to the circumferential area allowing the anchor to be driven into the media. The anchor can also include an inner centrical area wherein a component of the anchor when struck pushes down serrated edges and/or barbs so as to disengage with the media, allowing for removal with minimal force. The inner centrical area is not impacted when the special tool is used to drive the anchor due to a cavity in the tool corresponding to the inner centrical area structured to avoid the tool striking the anchor. Another side of the tool can be configured like a conventional hammer allowing force to be felt on the inner centrical area when struck thereby disengaging the serrated edges and/or barbs from the media below.

These and other features and advantages will become apparent from the following detailed description of illustrative embodiments thereof, which is to be read in connection with the accompanying drawings.

BRIEF DESCRIPTION OF THE DRAWINGS

The features and advantages of the present invention will be better understood when the Detailed Description of the Preferred Embodiments given below is considered in conjunction with the figures provided.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

In an embodiment of the invention, an integrated kiteboarding self-launching and self-landing safety system is displayed.

Figure 1:
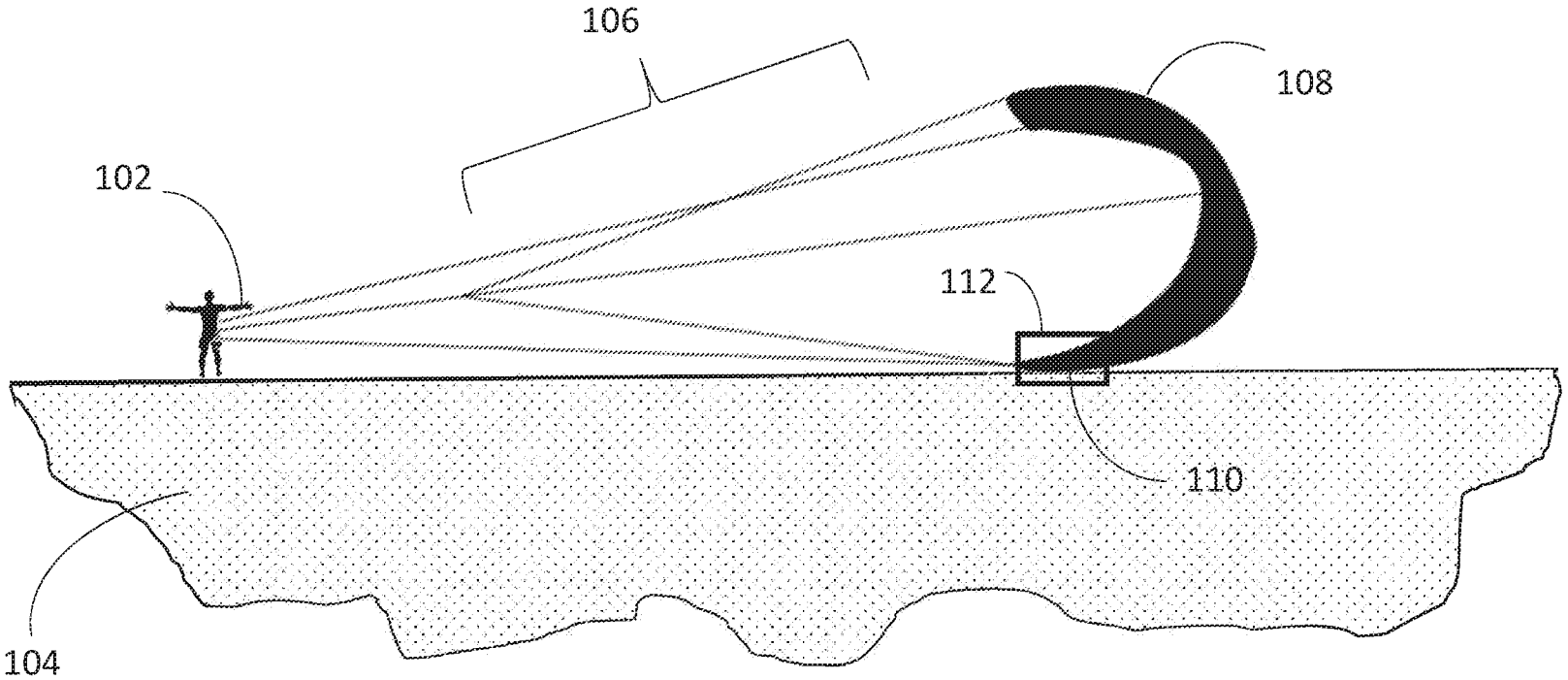
FIG. 1 is an elevation view of a secured canopy in accordance with an embodiment of the present invention.

As shown in FIG. 1, a sole kiteboarding operator 102 is above grade over media 104 and is tethered with lines 106 to a canopy 108. A leading edge 110 of the canopy 108 is held in place with a canopy securing device 112. As seen in FIG. 1, the operator 102 has the canopy 108 held in place with the canopy securing device 112 prior launching.

Figure 2:
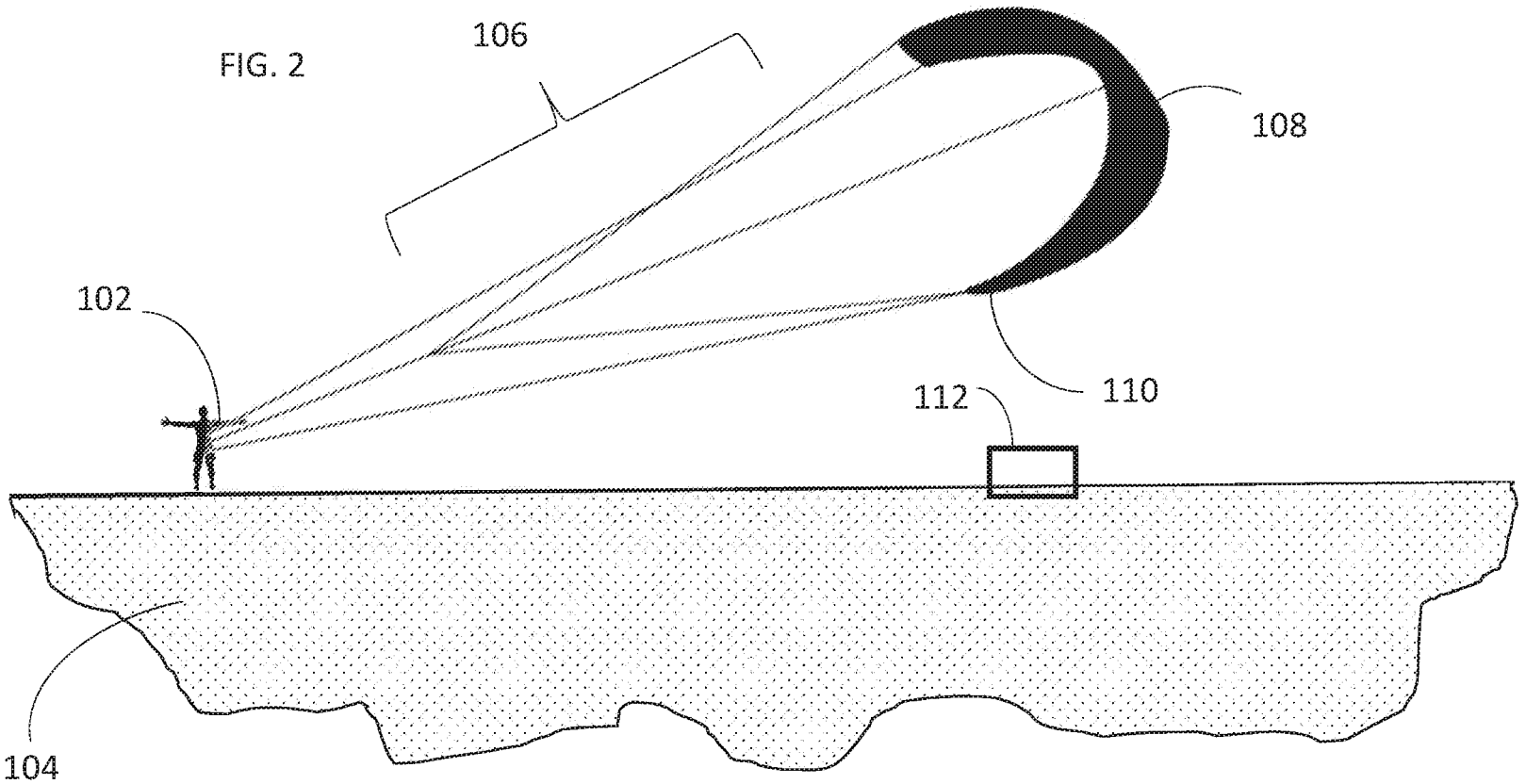
FIG. 2 is an elevation view of a canopy approaching a landing in accordance with an embodiment of the present invention.

As best seen in FIG. 2, the operator 102 is approaching the canopy securing device 112 while tethered to the canopy 108. The operator will actuate the canopy securing device 112 when the leading edge 110 of the canopy 108 is within clamping range of the canopy securing device 112.

Figure 3:
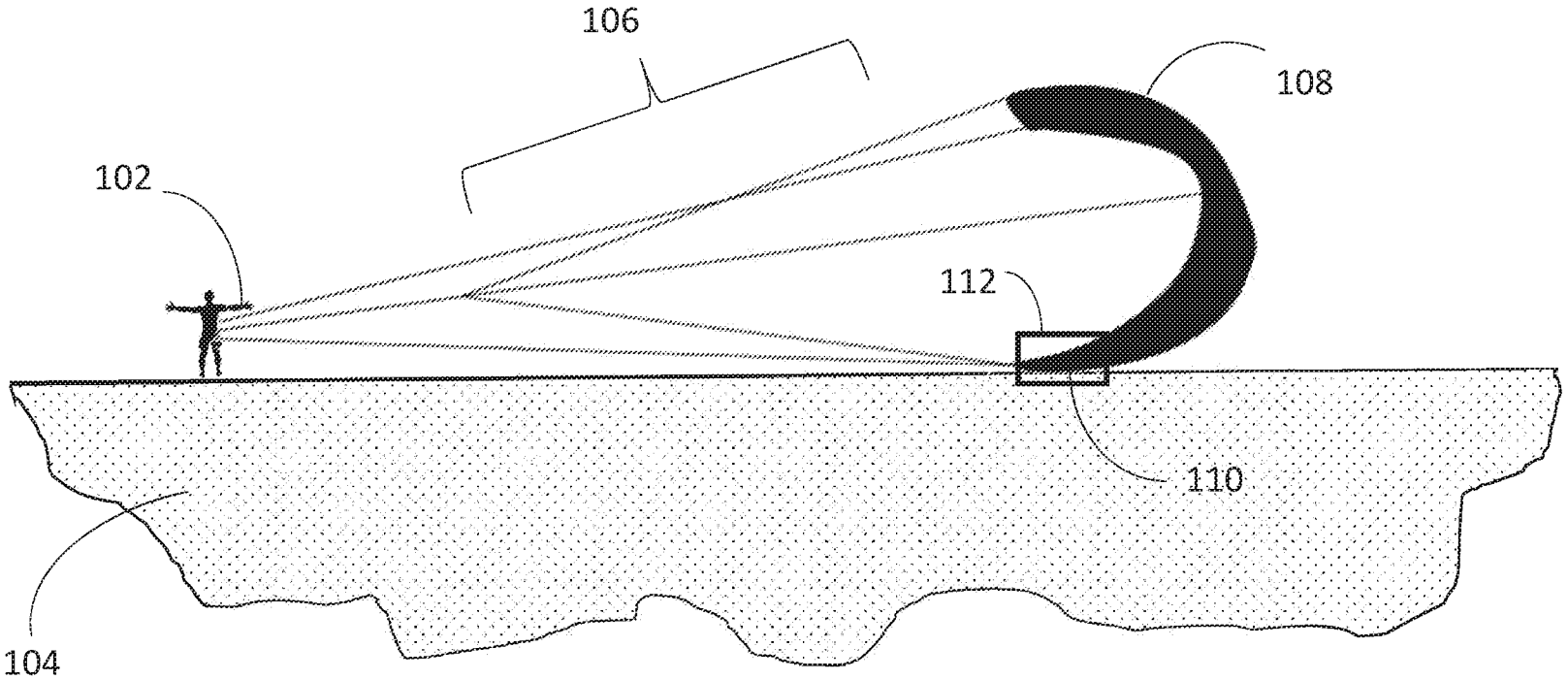
FIG. 3 is an elevation view of a secured canopy after landing in accordance with an embodiment of the present invention.

Turning to FIG. 3, the operator 102 is shown having the leading edge 110 of the canopy 108 held in place by the canopy securing mechanism. It is at this point that the operator 102 can safely begin to remove the kiteboarding gear.

Figure 4:
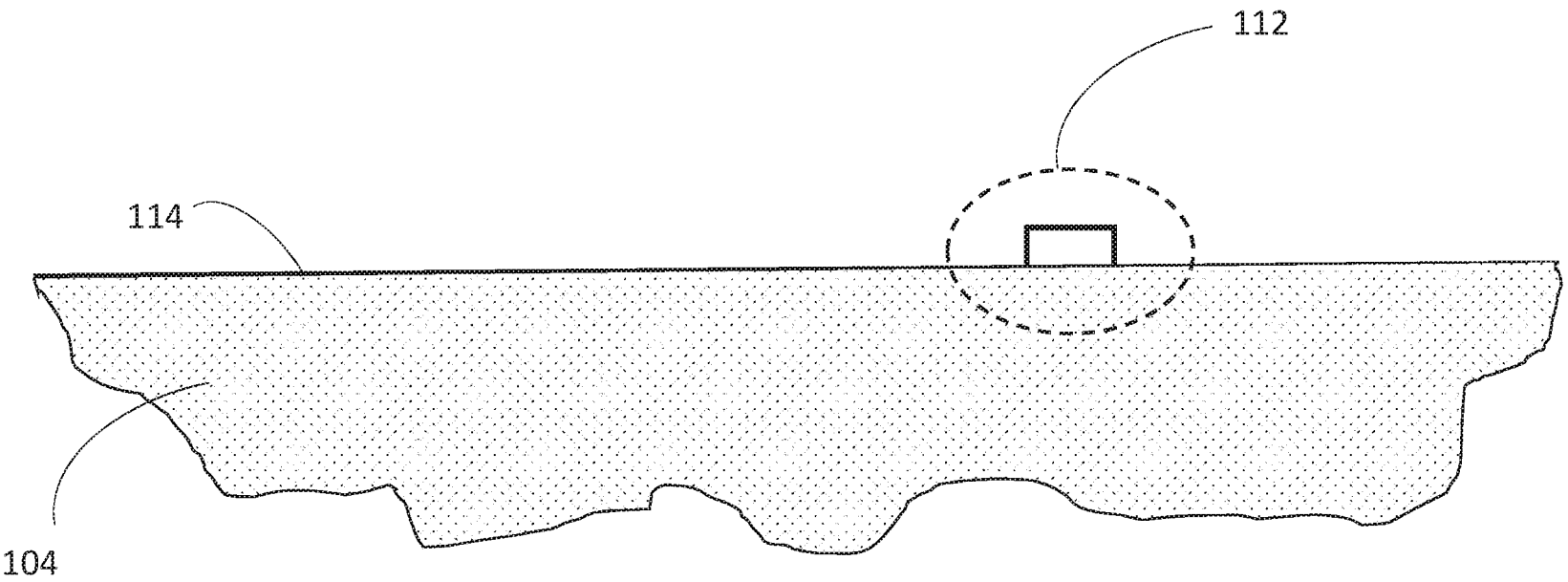
FIG. 4 is an elevation view of a canopy securing mechanism in accordance with an embodiment of the present invention.

Referencing FIG. 4, a side view of a canopy securing mechanism 112 is shown on a surface 114 of the media 104.

Figure 5:
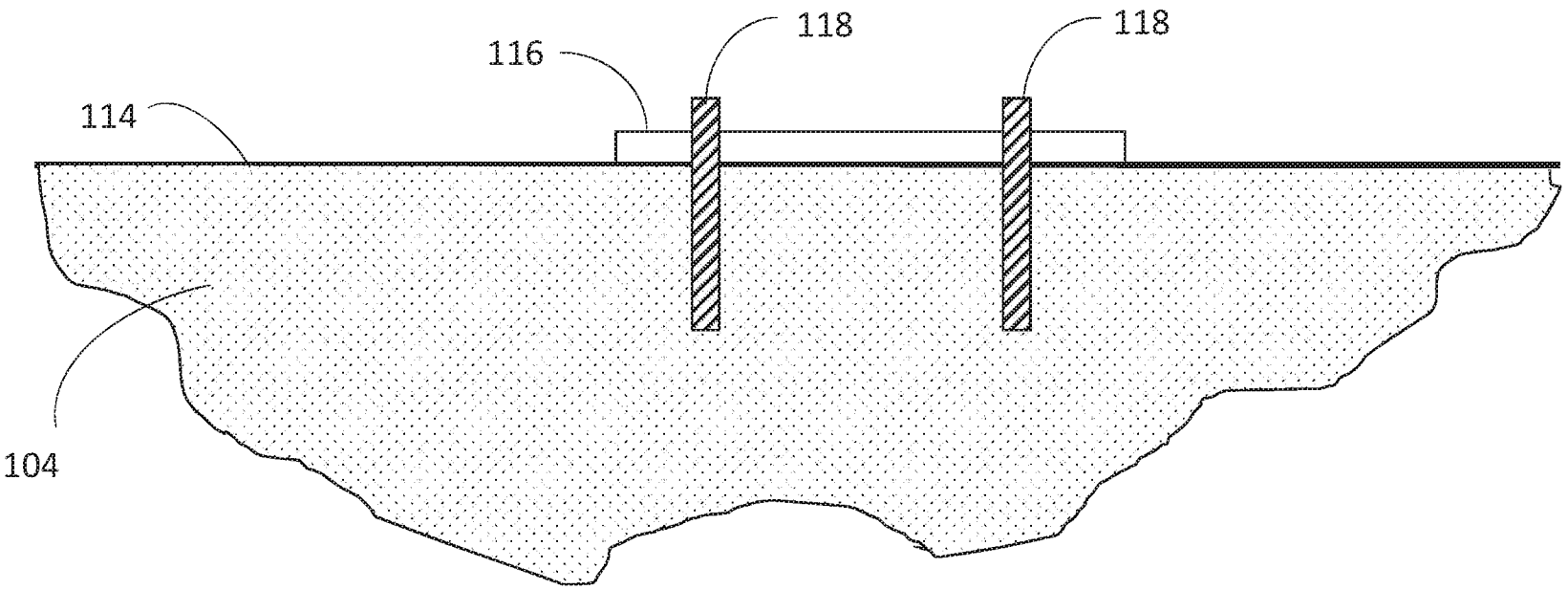
FIG. 5 is a is a side view of canopy securing mechanism displaying anchors in accordance with an embodiment of the present invention.

FIG. 5 displays a base 116 of the canopy securing mechanism 112 on top of the surface 114 of media 104. The base 116 is held in place with anchors devices 118. In embodiments not shown the anchor devices can include augers, stakes, spikes, screws, pins with retractable barbs, and/or anchors with teeth. The anchor devices configured to hold the base 116 of the canopy securing mechanism fixed to the surface 114 of the media 104.

Figure 6:
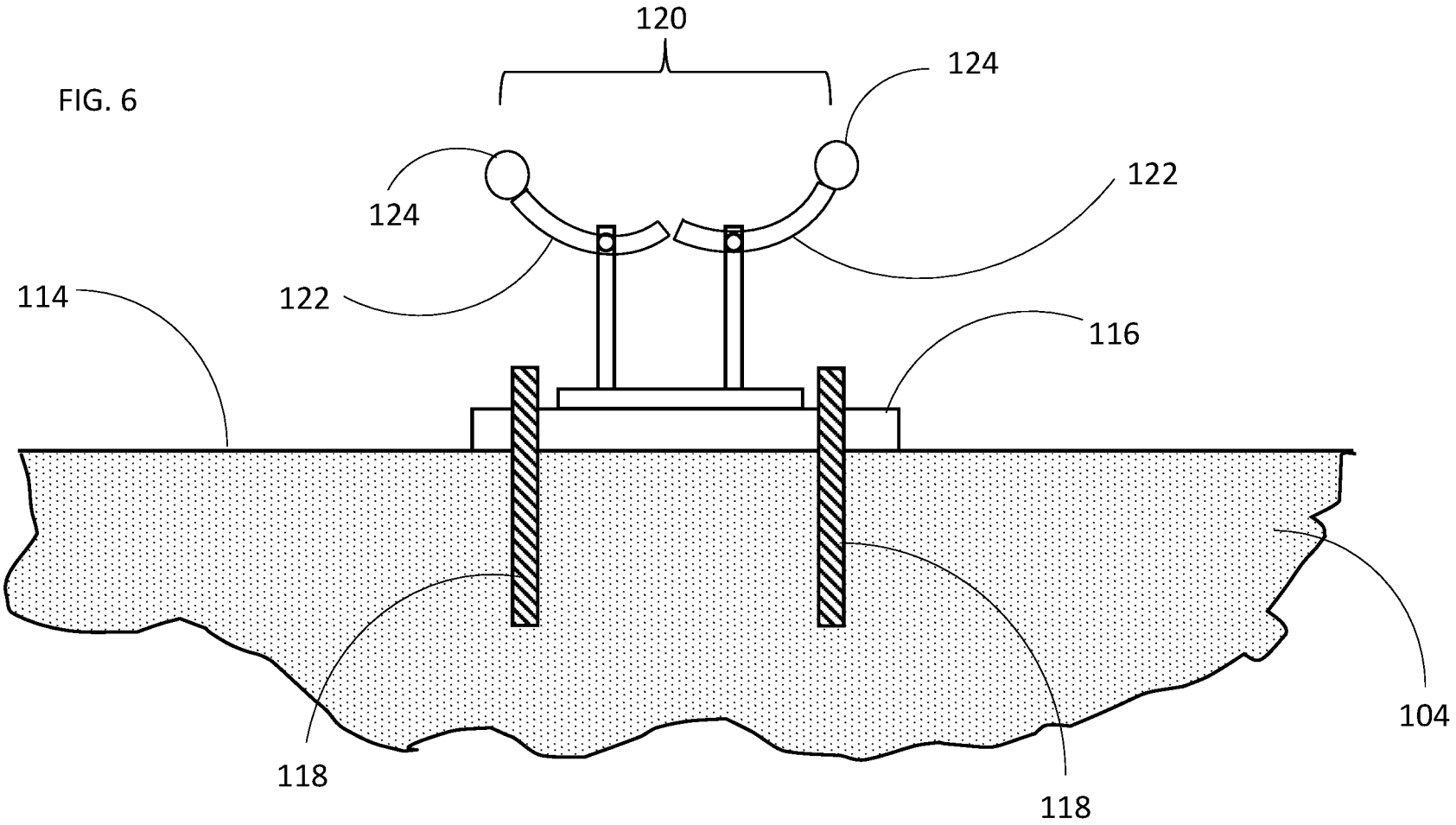
FIG. 6 is a side view of a canopy clamping device in accordance with an embodiment of the present invention.
Figure 7:
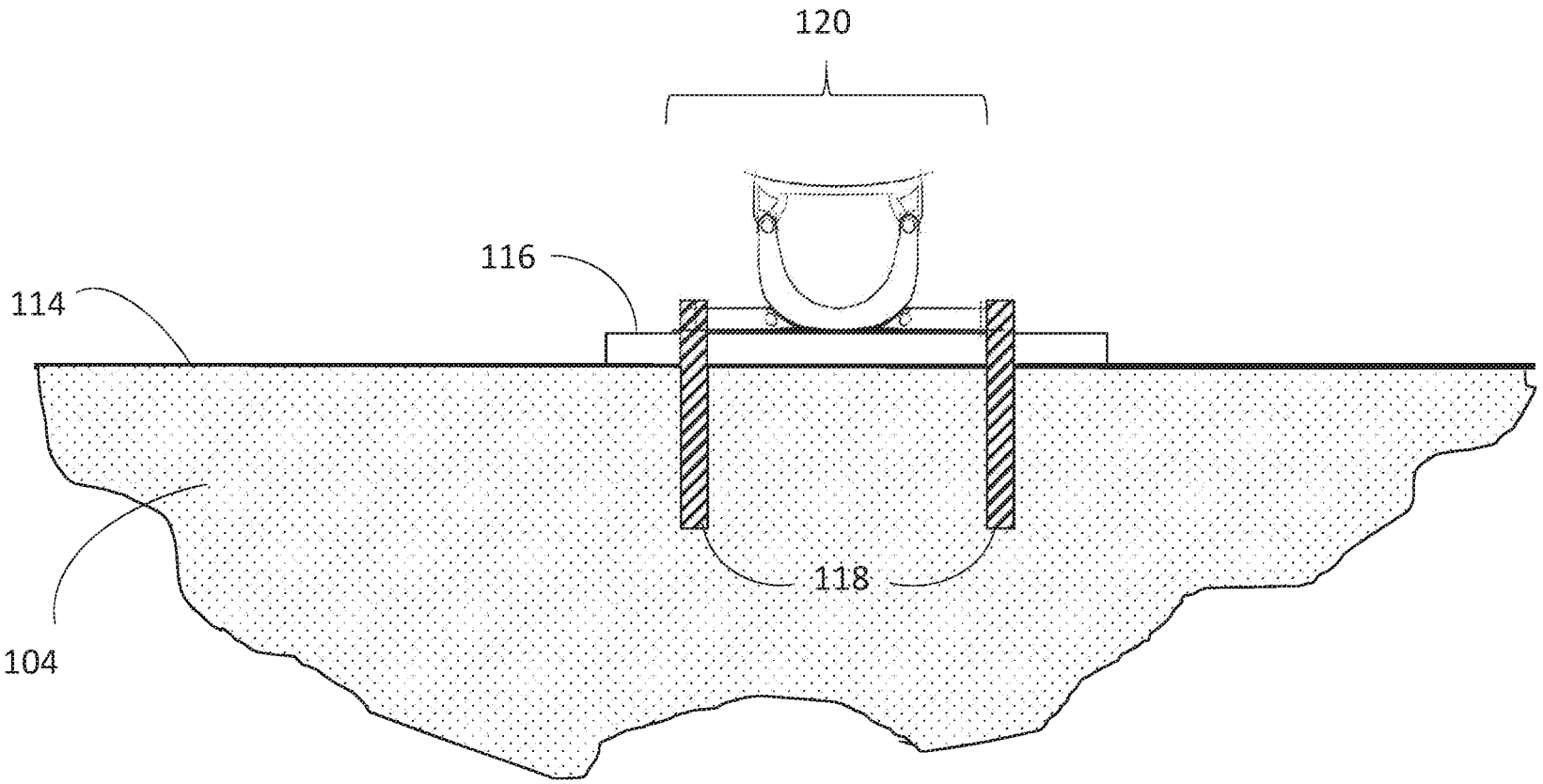
FIG. 7 is a side view of a canopy clamping device in accordance with an embodiment of the present invention.

FIG. 6 illustrates an embodiment of the present invention, showing a canopy clamping apparatus 120 mounted on a base 116 of a canopy securing mechanism 112. The canopy clamping apparatus 120 can include clamps 122, the clamps 122 configured to hold the leading edge 110 of the canopy 108 in place, as seen in FIG. 3. The apparatus 120 can include longitudinal inflatable tubes 124 mounted on the opposing longitudinally oriented pivoting arms 122 wherein the longitudinal inflatable tubes 124 are configured to interact with the inflatable canopy kiteboarding canopy edge. As seen in FIG. 6, the canopy securing mechanism is in open or ready for engagement mode. In embodiments not shown the canopy clamping apparatus 120 can include one or a plurality of arms and/or clamps. The one or plurality of arms arranged to act in concert to hold in place the leading edge 100 of a canopy 108 when the canopy securing mechanism is in closed or locked mode. In embodiments not shown the canopy securing mechanism can include a computer and/or processor with control platforms to actuate the securing mechanism with the computer. Further, the securing mechanism can include control platforms wherein the control platforms control the opening and closing of the canopy securing mechanism. The canopy securing mechanism can be actuated automatically using distance sensors, proximity sensors, SONAR, pressure transducers, lasers, LIDAR, and/or radar.

In embodiments not shown the opening and closing of the canopy securing mechanism can occur from receiving a wireless signal from the operator from a wrist band, mobile application, mobile device, and/or a worn device.

In embodiments not shown the system can include algorithms controlling computers to actuate the system to open and/or close.

In embodiments not shown the system can include pressure sensors, the pressure sensors configured to close the canopy securing mechanism when pressure from the leading edge 110 of the canopy 108 is felt on a surface of the canopy securing mechanism 112 when the canopy securing mechanism 112 is in the open position.

In some embodiments, the method or methods described above may be executed or carried out by a computing system including a tangible computer-readable storage medium, also described herein as a storage machine, that holds machine-readable instructions curable by a logic machine (i.e. a processor or programmable control device) to provide, implement, perform, and/or enact the above described methods, processes and/or tasks. When such methods and processes are implemented, the state of the storage machine may be changed to hold different data. For example, the storage machine may include memory devices such as various hard disk drives, CD, flash drives, cloud storage, or DVD devices. The logic machine may execute machine-readable instructions via one or more physical information and/or logic processing devices. For example, the logic machine may be configured to execute instructions to perform tasks for a computer program. The logic machine may include one or more processors to execute the machine-readable instructions. The computing system may include a display subsystem to display a graphical user interface (GUI) or any visual element of the methods or processes described above. For example, the display subsystem, storage machine, and logic machine may be integrated such that the above method may be executed while visual elements of the disclosed system and/or method are displayed on a display screen for user consumption. The computing system may include an input subsystem that receives user input. The input subsystem may be configured to connect to and receive input from devices such as a mouse, keyboard or gaming controller. For example, a user input may indicate a request that certain task is to be executed by the computing system, such as requesting the computing system to display any of the above described information, or requesting that the user input updates or modifies existing stored information for processing. A communication subsystem may allow the methods described above to be executed or provided over a computer network. For example, the communication subsystem may be configured to enable the computing system to communicate with a plurality of personal computing devices. The communication subsystem may include wired and/or wireless communication devices to facilitate networked communication. The described methods or processes may be executed, provided, or implemented for a user or one or more computing devices via a computer-program product such as via an application programming interface (API).

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

The present invention has been described with reference to the preferred embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

Although a very narrow claim is presented herein, it should be recognized the scope of this invention is much broader than presented by the claim. It is intended that broader claims will be submitted in an application that claims the benefit of priority from this application.

What is claimed:

1. An integrated kiteboarding canopy self-launching and landing safety system comprising:

a base;

an attachment mechanism configured to attach to the base, wherein the attachment mechanism is structured to capture and to release an inflatable kiteboarding canopy edge;

wherein the attachment mechanism comprises two opposing longitudinally oriented pivoting arms;

longitudinal inflatable tubes mounted on the opposing longitudinally oriented pivoting arms; and wherein the longitudinal inflatable tubes are configured to interact with the inflatable kiteboarding canopy edge to form a cooperating interface such that the system can capture and release an inflatable kiteboarding canopy edge;

a release mechanism positionable on the base, wherein the release mechanism is arranged to be able to release a kiteboarding canopy upon actuation, wherein the release mechanism includes an incorporated spring release;

a securing mechanism configured to connect with the base, wherein the securing mechanism is configured to secure a kiteboarding canopy upon landing wherein the securing mechanism includes solenoids and spring mechanisms to actuate the securing mechanism to cradle the kiteboarding canopy leading edge with and the longitudinal inflatable tubes mounted the two opposing longitudinally oriented pivoting arms; and a manual and automatic device to control both landing and launching evolutions, wherein the manual and automatic device includes a lanyard and wireless actuators.

* * * * *